US007798135B2

(12) United States Patent
Bischofberger et al.

(10) Patent No.: US 7,798,135 B2
(45) Date of Patent: Sep. 21, 2010

(54) EXHAUST GAS RECIRCULATION DEVICE

(75) Inventors: Ulrich Bischofberger, Esslingen (DE); Rafael Weisz, Waiblingen (DE); Andreas Grüner, Hattenhofen (DE)

(73) Assignee: Mahle International GmbH (DE)

( * ) Notice: Subject to any disclaimer, the term of this patent is extended or adjusted under 35 U.S.C. 154(b) by 0 days.

(21) Appl. No.: 11/912,827

(22) PCT Filed: Mar. 11, 2006

(86) PCT No.: PCT/DE2006/000431

§ 371 (c)(1),
(2), (4) Date: May 16, 2008

(87) PCT Pub. No.: WO2006/116957

PCT Pub. Date: Nov. 9, 2006

(65) Prior Publication Data

US 2009/0050120 A1 Feb. 26, 2009

(30) Foreign Application Priority Data

Apr. 29, 2005 (DE) ..... 10 2005 020 484

(51) Int. Cl.
*F02B 47/08* (2006.01)
*F02M 25/07* (2006.01)

(52) U.S. Cl. ..... 123/568.18; 123/568.11; 123/568.17

(58) Field of Classification Search ..... 123/568.11, 123/568.17, 568.18, 569.19, 590; 137/561 A; 60/278, 280, 605.2
See application file for complete search history.

(56) References Cited

U.S. PATENT DOCUMENTS 3,680,534 A * 8/1972 Chavant ..... 123/568.17
3,996,748 A 12/1976 Melchior (Continued)

FOREIGN PATENT DOCUMENTS

DE 4429232 9/1995

(Continued)

OTHER PUBLICATIONS

English abstract provided for EP-1213467.

(Continued)

*Primary Examiner*—Stephen K Cronin
*Assistant Examiner*—Sizo B Vilakazi
(74) *Attorney, Agent, or Firm*—Rader, Fishman & Grauer PLLC

(57) ABSTRACT

The invention relates to an exhaust gas recirculation device (1) for an internal combustion engine, in particular in a motor vehicle, having an exhaust gas recirculation line (2) for introducing exhaust gas into a primary intake line (4), with an exhaust gas recirculation valve (3) for controlling the exhaust gas recirculation line (2). The exhaust gas recirculation line (2) has an end section (7) which runs into the primary intake line (4) with an orifice opening (8). In order to improve the reliability of the exhaust gas recirculation device (1), the exhaust gas recirculation valve (3) has a sleeve (10) arranged in the fresh air line (4), said sleeve (10) enclosing the exhaust gas recirculation line (2) in the region of the orifice opening (8), being mounted in the fresh air line (4) so as to be axially adjustable, and presenting a radial internal nozzle contour (11) with a flow cross section which first decreases and then increases in size in the flow direction, the exhaust gas recirculation valve (3) having an actuating device (12) for axially adjusting the sleeve (10) relative to the primary intake line.

14 Claims, 9 Drawing Sheets

U.S. PATENT DOCUMENTS

Figure 1:
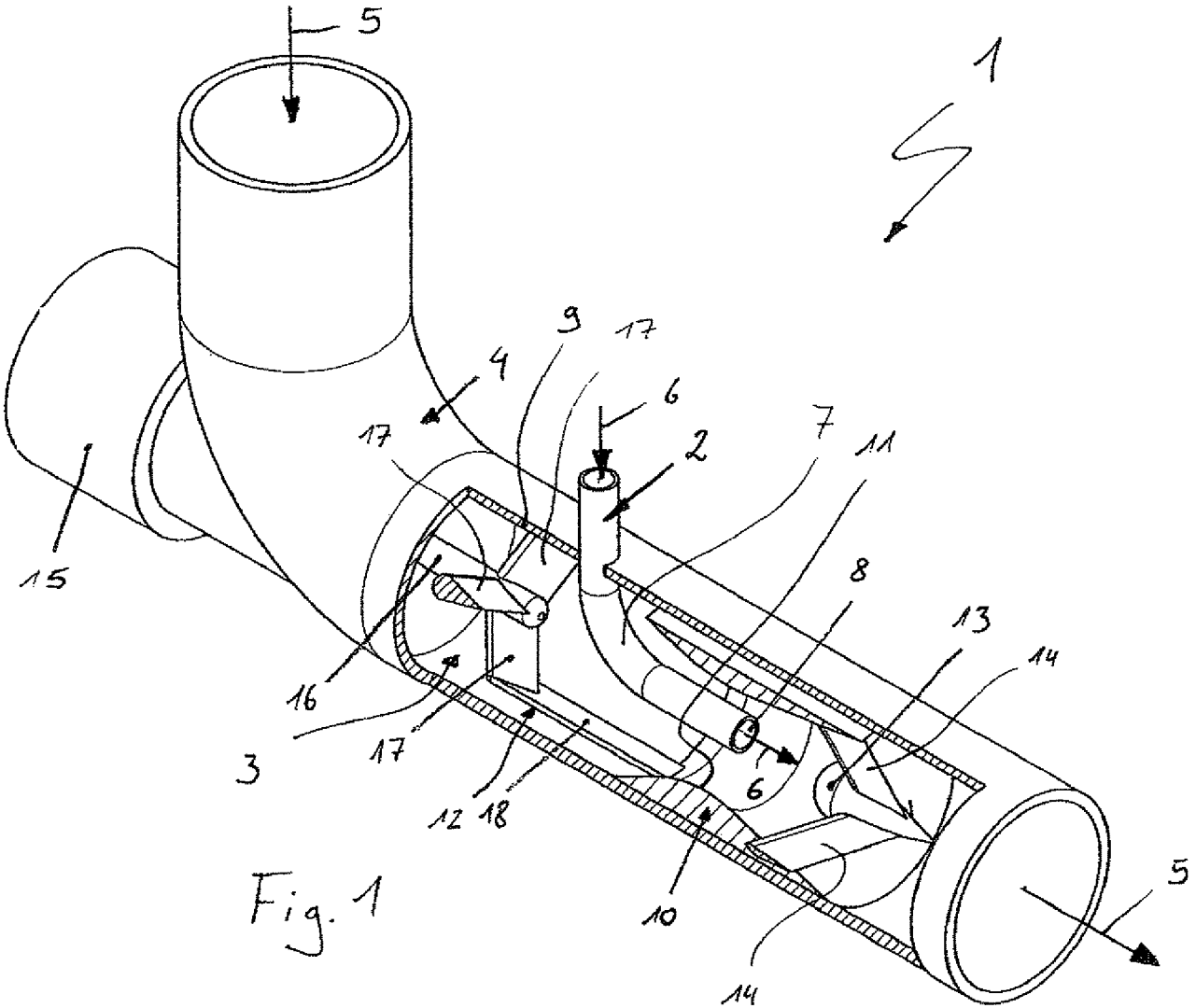

| | | | | |
|---|---|---|---|---|
| 5,611,204 | A | 3/1997 | Radovanovic et al. | |
| 5,785,034 | A * | 7/1998 | Moedinger et al. | 123/568.18 |
| 6,267,106 | B1 * | 7/2001 | Feucht | 123/568.17 |
| 6,343,594 | B1 * | 2/2002 | Koeslin et al. | 123/568.17 |
| 6,345,612 | B1 * | 2/2002 | Gartner | 123/568.11 |
| 6,502,397 | B1 * | 1/2003 | Lundqvist | 60/605.2 |
| 6,886,544 | B1 * | 5/2005 | Bui | 123/568.18 |
| 7,261,096 | B2 * | 8/2007 | Berggren et al. | 123/568.18 |
| 7,353,811 | B2 * | 4/2008 | Weisz | 123/568.17 |
| 7,389,770 | B2 * | 6/2008 | Bertilsson et al. | 123/568.17 |
| 2004/0099257 | A1 * | 5/2004 | Berggren et al. | 123/568.17 |
| 2005/0183704 | A1 * | 8/2005 | Usui | 123/568.17 |

FOREIGN PATENT DOCUMENTS

| | | |
|---|---|---|
| DE | 10019409 | 8/2007 |
| EP | 0607505 | 10/1993 |
| EP | 1213467 | 6/2002 |

OTHER PUBLICATIONS

English abstract provided for EP-0607505.
English abstract provided for DE-4429232.

* cited by examiner

EXHAUST GAS RECIRCULATION DEVICE

CROSS-REFERENCE TO RELATED APPLICATION

This application is a U.S. national phase of International application PCT/DE2006/000431 filed Mar. 11, 2006, which claims priority to German application DE 10 2005 020 484.8 filed Apr. 29, 2005, which are hereby incorporated by reference in their entirety.

The present invention relates to an exhaust gas recirculation device for an internal combustion engine, in particular in a motor vehicle, having the features of the preamble of Claim 1.

An exhaust gas recirculation device of this type is known from U.S. Pat. No. 6,502,397, which is equipped with an exhaust gas recirculation line for introducing exhaust gas into a fresh air line of the internal combustion engine. Furthermore, an exhaust gas recirculation valve is provided for controlling the exhaust gas recirculation line. The exhaust gas recirculation line has an end section, which runs inside the fresh air line and which has an axially open orifice opening. The exhaust gas recirculation line thus penetrates an envelope of the fresh air line to be able to introduce the recirculated exhaust gases into the fresh air line. In the known exhaust gas recirculation device, the exhaust gas recirculation line comprises a pipe which is mounted so it is axially adjustable in relation to the fresh air line, which has an orifice opening at the outlet and an inlet opening at the intake, as well as a feed section, which is connected to a connection chamber, in which the inlet opening of the pipe is also located. The exhaust gas recirculation valve comprises a final control element, with the aid of which the pipe is adjustable between an open position, in which the inlet opening is at an axial distance from a valve seat, and a closed position, in which the inlet opening of the pipe presses against the valve seat to form a seal. The recirculation rate may be set by changing the distance between valve seat and inlet opening of the pipe. The pipe is subjected to the recirculated exhaust gases in the area of its inlet opening. An actuator, via which the final control element axially drives the pipe, is also subjected to recirculated exhaust gases. The components of the exhaust gas recirculation device which are subjected to the exhaust gas may foul and/or soot. This may result in sluggishness and in the extreme case seizing of the exhaust gas recirculation valve, which endangers proper function of the exhaust gas recirculation device.

The present invention begins here. The present invention is concerned with the problem of specifying an improved embodiment of an exhaust gas recirculation device of the type cited at the beginning, in which the danger of functional impairment by fouling and/or sooting is reduced in particular.

This problem is solved according to the present invention by the subject matter of the independent claim. Advantageous embodiments are the subject matter of the dependent claims.

The present invention is based on the general idea of aerodynamically controlling the recirculation rate using a nozzle. The recirculation rate is controlled by the axial relative position between orifice opening and nozzle, because the pressure existing in the orifice opening is a function of the axial position of the orifice opening within the nozzle. This control principle is combined in the present invention with the end section having the orifice opening being situated fixed inside the fresh air line, while a sleeve having or implementing the nozzle is situated so it is adjustable in the fresh air line. In this way, the exhaust gas flow reaches the orifice opening unobstructed, without impinging on movable parts. Furthermore, it is possible through the suggested construction to adjust the sleeve using a final control element, without the final control element being impinged by the recirculated exhaust gases. This construction reduces the danger of fouling or sooting of components of the exhaust gas recirculation device, because contact with the recirculated exhaust gases is largely avoided. In addition, the exhaust gases are introduced into the fresh air flow in the area of the nozzle, i.e., in an area of elevated flow velocities. Higher flow velocities reduce the danger of fouling and sooting, however.

According to an especially advantageous embodiment, at least one closure body may be situated on the sleeve, preferably coaxial to the orifice opening, which, when the sleeve is maximally adjusted upstream, works together with the orifice opening to set a minimal opening cross-section of the at least one exhaust gas recirculation line. In this way, the recirculation rate may be mechanically controlled in limits which may no longer be aerodynamically controlled. In particular, in the limiting case, a recirculation rate having the value zero may also be set. I.e., the exhaust gas recirculation line may be blocked in that the closure body closes the orifice opening.

According to another advantageous embodiment, the final control element, with the aid of which the sleeve may be axially adjusted in relation to the fresh air line, may be equipped with at least one electromagnetic actuating drive, which may axially adjust the sleeve using electromagnetic forces. Because movable parts are thus dispensed with on the part of the actuating drive, the danger of fouling or sooting of components of the actuating drive is also reduced. Simultaneously, it is possible to situate the actuating drive outside the fresh air line, so that the complete actuating drive is subjected to neither the exhaust gases nor the fresh air.

Further important features and advantages of the present invention result from the subclaims, the drawings, and the associated description of the figures on the basis of the drawings.

It is obvious that the features cited above and to be explained in the following are usable not only in the particular specified combination, but rather also in other combinations or alone, without leaving the scope of the present invention.

Preferred exemplary embodiments of the present invention are illustrated in the drawings and are explained in greater detail in the following description, identical reference numerals referring to identical or similar or functionally identical components.

FIGS. 1 through 9 each schematically show a perspective view in partial section of an exhaust gas recirculation device according to the present invention, in different states and/or in different embodiments.

According to FIGS. 1 through 9, an exhaust gas recirculation device 1 according to the present invention comprises an exhaust gas recirculation line 2 and an exhaust gas recirculation valve 3. The term "exhaust gas recirculation" is abbreviated in the following by EGR. The exhaust gas recirculation device 1 or the EGR device 1 is used in an internal combustion engine (not shown here) for the purpose of returning a part of the exhaust gases which arise in operation of the internal combustion engine to the fresh air side of the internal combustion engine. Motor vehicles in particular are equipped with internal combustion engines which have an EGR device 1.

Correspondingly, FIGS. 1 through 9 show a fresh air line 4 of the internal combustion engine (otherwise not shown), which is used to feed fresh air to the cylinders and/or the combustion chambers of the internal combustion engine. A corresponding fresh air flow is indicated by arrows 5. The EGR line 2 is used for introducing exhaust gas into the fresh air line 4. A corresponding exhaust gas flow is indicated by arrows 6. The EGR line 2 has an end section 7, which has an axially open orifice opening 8, which is expediently open in the flow direction of the fresh air flow 5. Furthermore, the end section 7 runs inside the fresh air line 4. For this purpose, the EGR line 2 is led through an envelope 9 of the fresh air line 4. The fresh air line 4 may preferably extend linearly in the area in which the EGR line 2 is inserted therein.

The EGR line 2 may be controlled with the aid of the EGR valve 3. I.e., the quantity of the recirculated exhaust gases, thus the EGR rate, may be set with the aid of the EGR valve 3. For this purpose, the EGR valve 3 has a sleeve 10. The sleeve 10 is situated in the interior of the fresh air line 4, in such a way that it envelops the EGR line 2 and/or its end section 7 in the area of the orifice opening 8. Furthermore, the sleeve 10 is provided on its interior side facing toward the orifice opening 8, i.e., its radial interior, with a nozzle contour 11. This nozzle contour 11 is characterized in that it has a flow cross-section which first decreases and then increases again in the flow direction of the fresh air flow 5. An inflow-side axial section of the nozzle contour 11 having the decreasing flow cross-section is axially shorter than an outflow-side axial section having the increasing flow cross-section. For example, the inflow-side axial section is approximately half as large as the outflow-side axial section. The nozzle contour 11 is expediently designed as a Venturi nozzle, i.e., the cross-sectional shape inside the nozzle contour 11 is selected in such a way that it implements a Venturi nozzle.

Furthermore, the sleeve 10 is situated so it is axially adjustable in relation to the fresh air line 4 and is preferably mounted so it is axially adjustable on the fresh air line 4 for this purpose. In addition, the EGR valve 3 comprises a final control element 12, with the aid of which the sleeve 10 may be adjusted in relation to the fresh air line 4. The relative position of the orifice opening 8 within the nozzle contour 11 may be set by the adjustability of the sleeve 10. Upon flow through the nozzle contour 11, there is a change of the pressure existing in the fresh air flow 5, the current pressure value being a function of the current position within the nozzle contour 11. Correspondingly, the pressure existing at the orifice opening 8 may be varied by setting the relative position between orifice opening 8 and sleeve 10. However, the quantity of the recirculated exhaust gases, i.e., the EGR rate, is also correlated with the pressure existing at the orifice opening 8. Finally, the EGR rate may thus be set by positioning the sleeve 10 in relation to the orifice opening 8.

In the embodiments shown here, the EGR valve 3 is additionally equipped with at least one closure body 13, which is situated fixed in relation to the sleeve 10. This closure body 13 is positioned coaxially to the orifice opening 8. Upon an adjustment of the sleeve 10 opposite to the fresh air flow 5, the closure body 13 approaches the orifice opening 8. When the sleeve 10 is adjusted maximally upstream, the closure body 13 works together with the orifice opening 8 to set a minimal opening cross-section of the EGR line 2.

Figure 2:
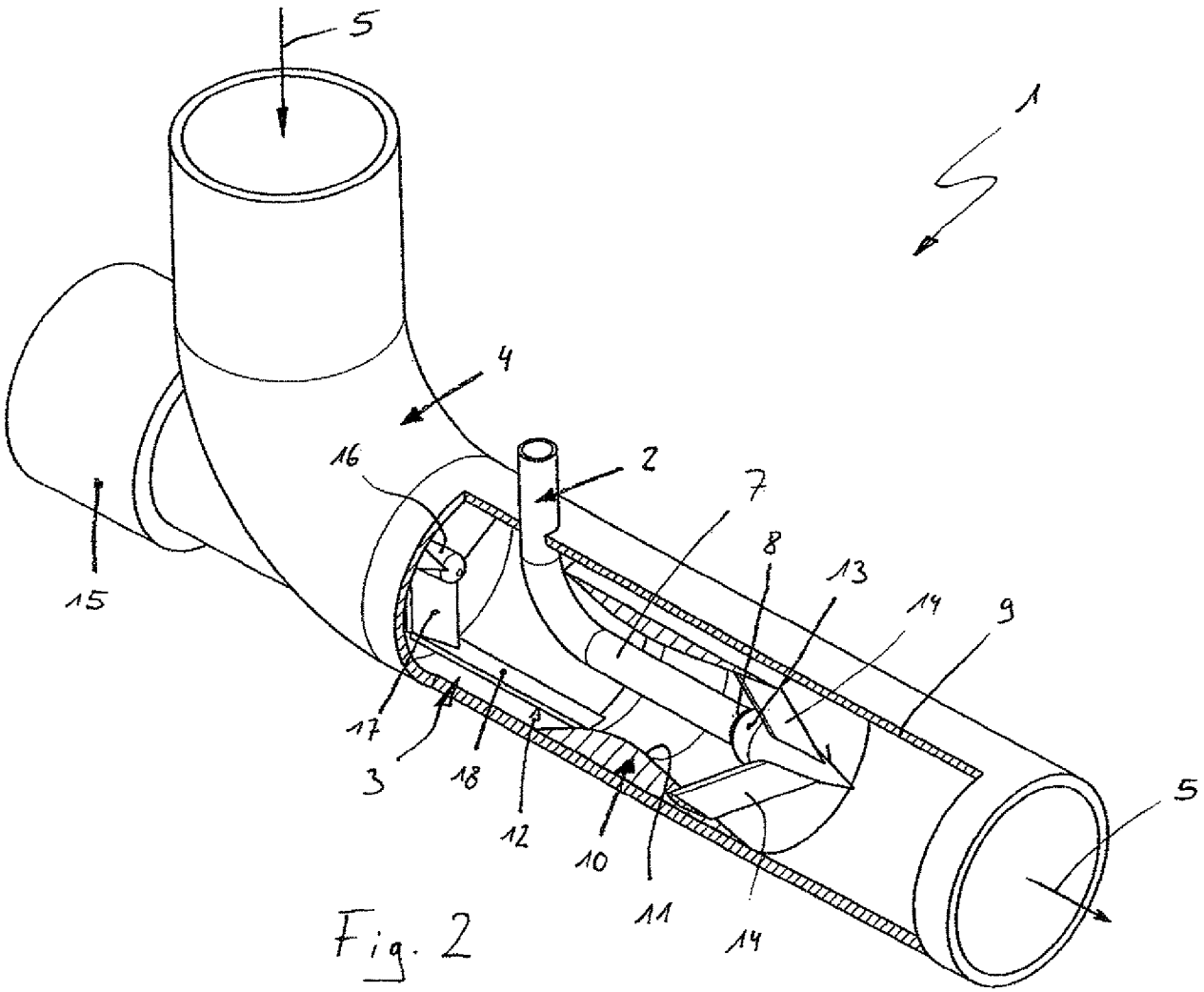

FIG. 2 shows the embodiment from FIG. 1 with sleeve 10 adjusted maximally upstream. In this embodiment, the sleeve 10 may be adjusted upstream enough that the closure body 13 closes the orifice opening 8. The EGR line 2 is thus blocked. It is also fundamentally possible to select the maximally upstream adjusted position of the sleeve 10 in such a way that the minimal opening cross-section is formed by a gap, preferably by a ring gap, which remains between the closure body 13 and the end section 7.

The closure body 13 is expediently equipped with a flow profile. This flow profile may be designed as a streamlined profile, for example. Preferably, the closure body 13 has a semispherical profile on the inflow side in the embodiments shown here and may be equipped with a conical profile on the outflow side. It is essential that the closure body 13, if it is provided for closing the orifice opening 8, is shaped complementarily to the orifice opening 8 at least on the inflow side. Therefore, for a circular orifice opening 8, a semispherical shape is preferred for the inflow side of the closure body 13. Other shapes for the closure body 13 which are also distinguished by a low flow resistance are also fundamentally conceivable.

Moreover, the closure body 13 and additionally or alternatively the particular orifice opening 8 may be provided with an adhesion-reducing coating. A coating of this type using PTFE or silicone, for example, may reduce an accumulation of dirt particles on the orifice opening 8 and/or on the closure body 13. Optionally, at least one seal element may also be provided, which is situated on the closure body 13 and/or on the orifice opening 8.

The closure body 13 is fastened to the sleeve 10. The connection between sleeve 10 and closure body 13 is preferably produced using at least one radial web 14. In the embodiments of FIGS. 1 through 3 and 6 through 8, three radial webs 14 are provided to fasten the closure body 13 to the sleeve 10. In contrast thereto, in the embodiments of FIGS. 4 and 5 as well as 9, only one radial web 14 is provided in each case for the connection between closure body 13 and sleeve 10.

The final control element 12 comprises an actuating drive 15, with the aid of which the sleeve 10 is drivable. In the embodiments of FIGS. 1 through 4 and 6 through 9, the actuating drive 15 drives an actuator 16, which is connected to the sleeve 10. This actuator 16 is expediently situated upstream from the orifice opening 8, so that impingement of the actuator 16 with exhaust gas may be avoided. In the embodiments of FIGS. 1 through 3 and 6 through 8, the actuator 16 is provided on its outflow-side end with at least one radial web 17, which is connected via an axial web 18 to the sleeve 10. In the embodiments shown, three radial webs 17 are provided in each case, which are each connected via an axial web 18 to the sleeve 10.

Figure 4:
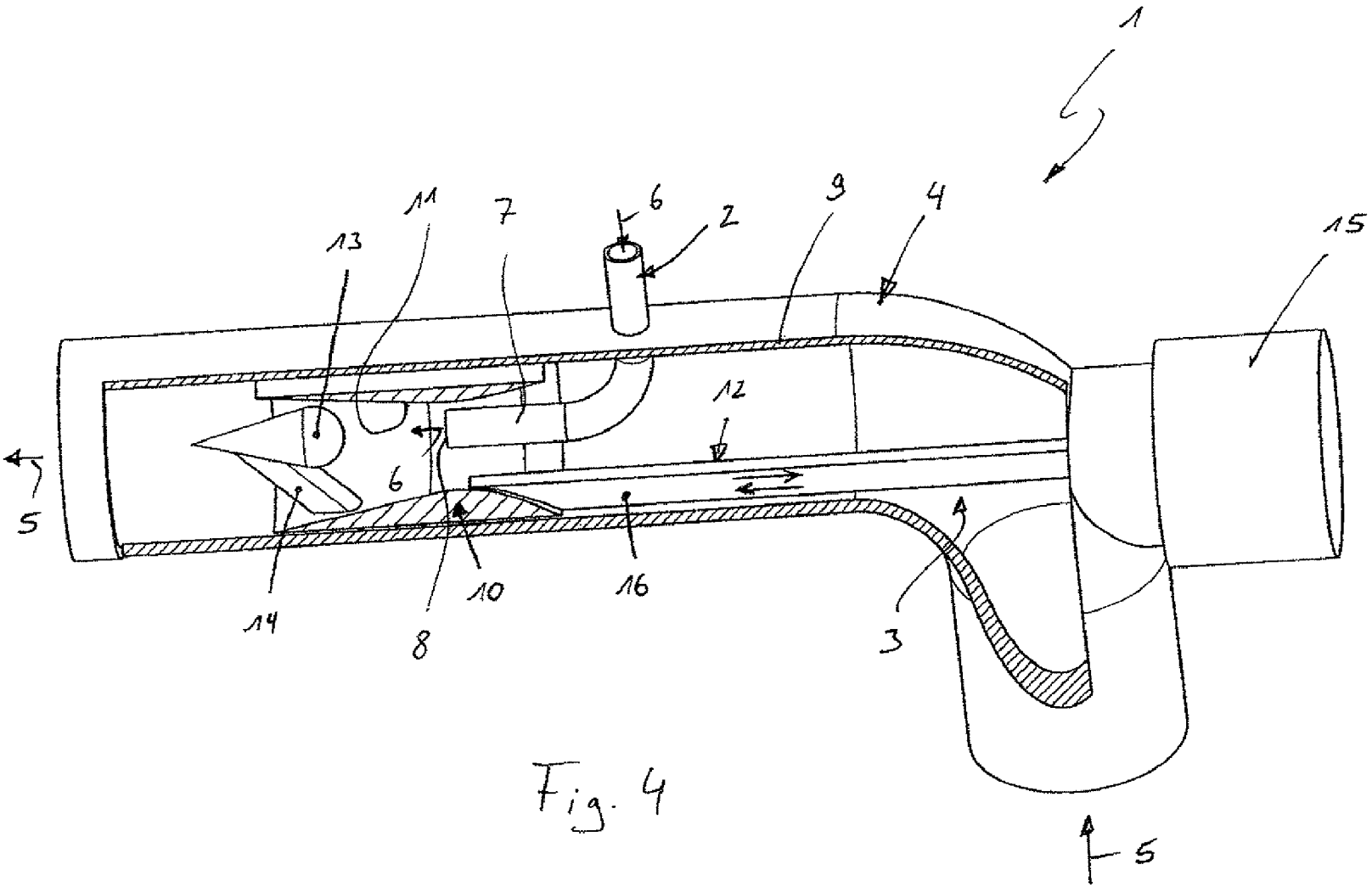
Figure 9:
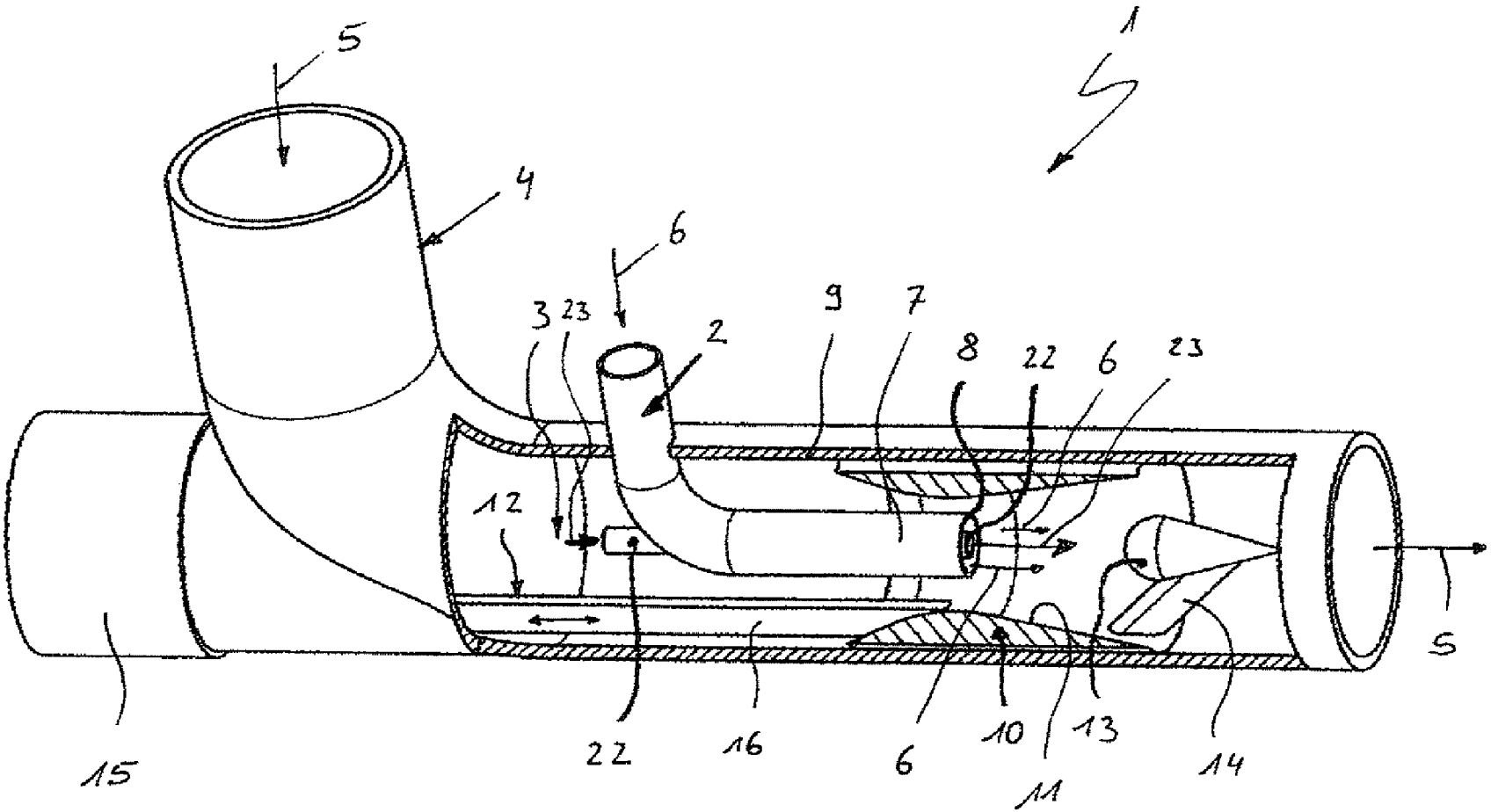

In contrast thereto, in the embodiments of FIGS. 4 and 9, the actuator 16 is connected directly to the sleeve 10, which is achieved by a corresponding configuration of the actuator 16 selected in proximity to the envelope 9. This embodiment may be implemented with reduced outlay and may have a comparatively low flow resistance.

In the embodiments of FIGS. 1 and 2, 4, and 6 through 9, the actuating drive 15 is situated outside the fresh air line 4. The actuator 16 penetrates the envelope 9 of the fresh air line 4 to form a seal in these embodiments. Furthermore, the fresh air line 4 is curved in the area in which the actuator 16 is led through the envelope 9, to reduce the outlay to implement axial adjustability of the actuator 16 with the aid of the actuating drive 15.

Figure 3:
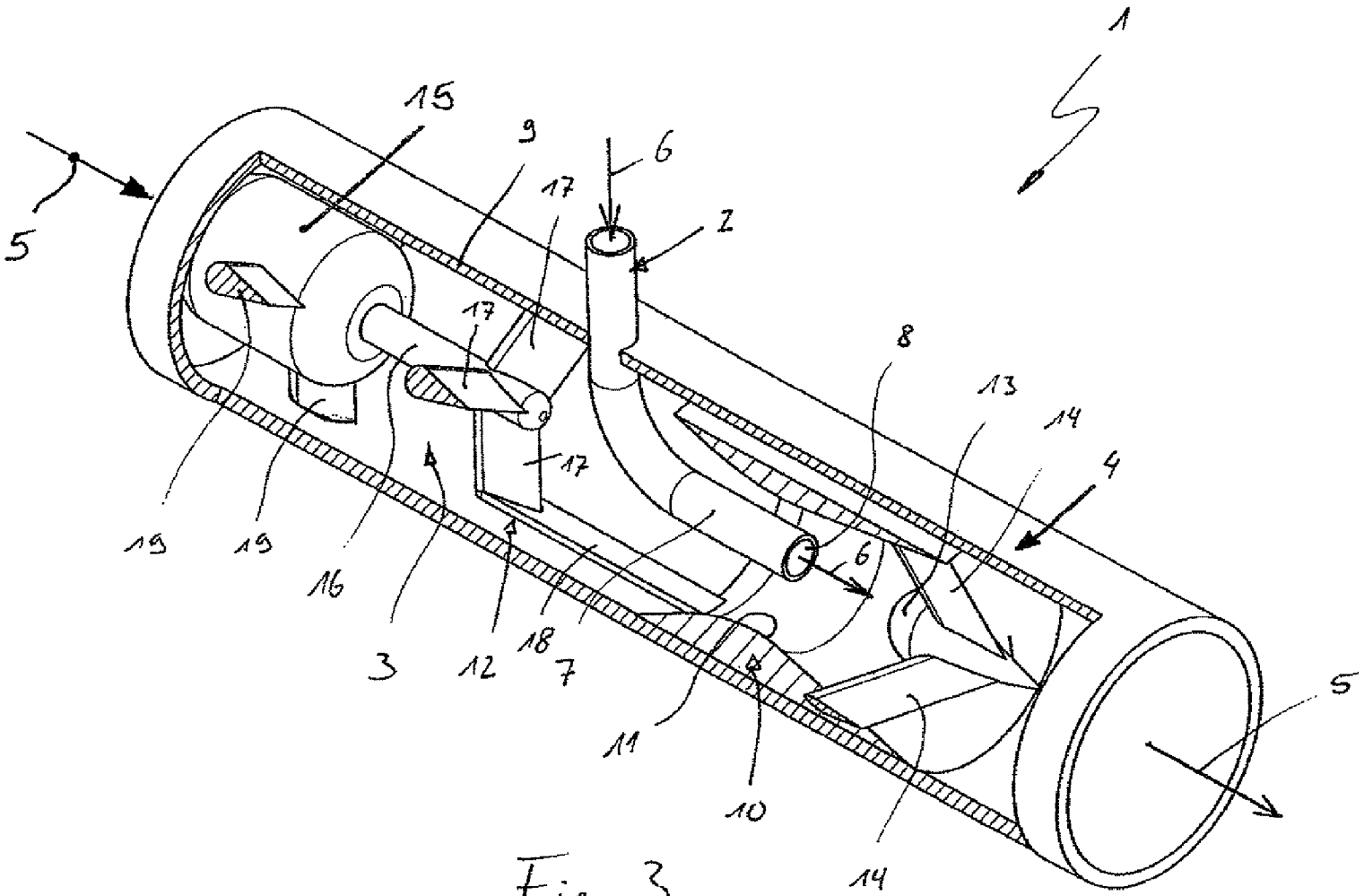

In contrast thereto, in the embodiment shown in FIG. 3, the actuating drive 15 is situated in the interior of the fresh air line 4, expediently upstream from the orifice opening 8, to also avoid impingement of the actuating drive 15 with exhaust gas here. The actuating drive 15 may be dimensioned so small in regard to its cross-section, as here in FIG. 3, that it may have the fresh air flow 5 flow around its circumference. For this purpose, the actuating drive 15 is fastened via radial webs 19 to the envelope 9 of the fresh air line 4. With an actuating drive 15 driven by an electric motor, power supply lines and control lines may be led through one of the radial webs 19.

As may be recognized especially clearly here, the individual radial webs 19 and/or 17 and/or 14 may be aerodynamically profiled in such a way that they have the lowest possible flow resistance.

The embodiment shown in FIG. 3 may be integrated especially simply in the fresh air line 4. However, it is fundamentally clear that the fresh air line 4 may also have an appropriately expanded cross-section in the area of the actuating drive 15 to reduce the flow resistance in this area.

Figure 5:
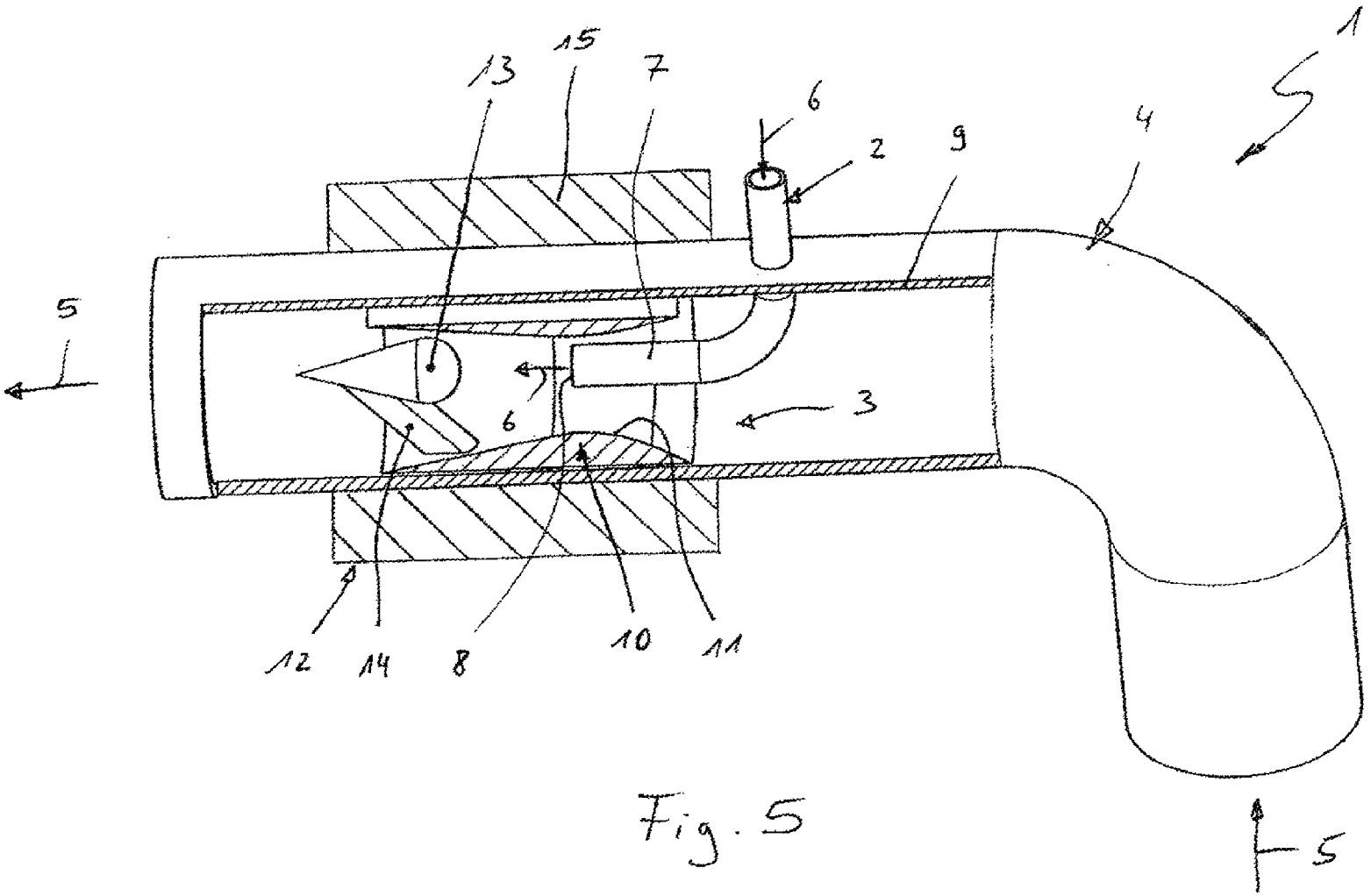

In the embodiment according to FIG. 5, the actuating drive 15 manages without actuator 16, because the actuating drive 15 operates electromagnetically in this embodiment. Correspondingly, the actuating drive 15 may also be situated outside the fresh air line 4 here. For example, the actuating drive 15 extends coaxially to the fresh air line 4 in the area of the sleeve 10 and may particularly press externally against the envelope 9. The actuating drive 15 works together contactlessly with the sleeve 10 in this embodiment via electromagnetic forces, through the envelope 9. It is clear that the sleeve 10 and the envelope 9 are produced from appropriate materials for this purpose. For example, the envelope 9 of the fresh air line 4 comprises a plastic, while the sleeve 10 is formed by a ferromagnetic material. In this embodiment, no movable components thus exist in addition to the sleeve 10, by which the danger of fouling or sooting and thus a Functional impairment of the EGR valve 3 is reduced.

Additionally or alternatively, the electromagnetically operating actuating drive 15 may also work together with an actuator 16 (not shown here), which is connected to the sleeve 10 to drive the sleeve 10 for axial adjustment.

According to an advantageous embodiment, the EGR valve 3 may additionally be equipped with a restoring device, which is not shown in the embodiments shown here, however. A restoring device of this type may be provided in the form of a restoring spring, for example, and may particularly be integrated in the actuating drive 15. The restoring device is designed in such a way that it drives the sleeve 10 upstream in the event of malfunctioning or shutdown final control element 12. With the aid of the restoring device, the sleeve 10 thus assumes a position having minimized EGR rate by itself. If the closure body 13 is provided, it is driven into the position having minimal opening cross-section and/or into the closure position.

Figure 6:
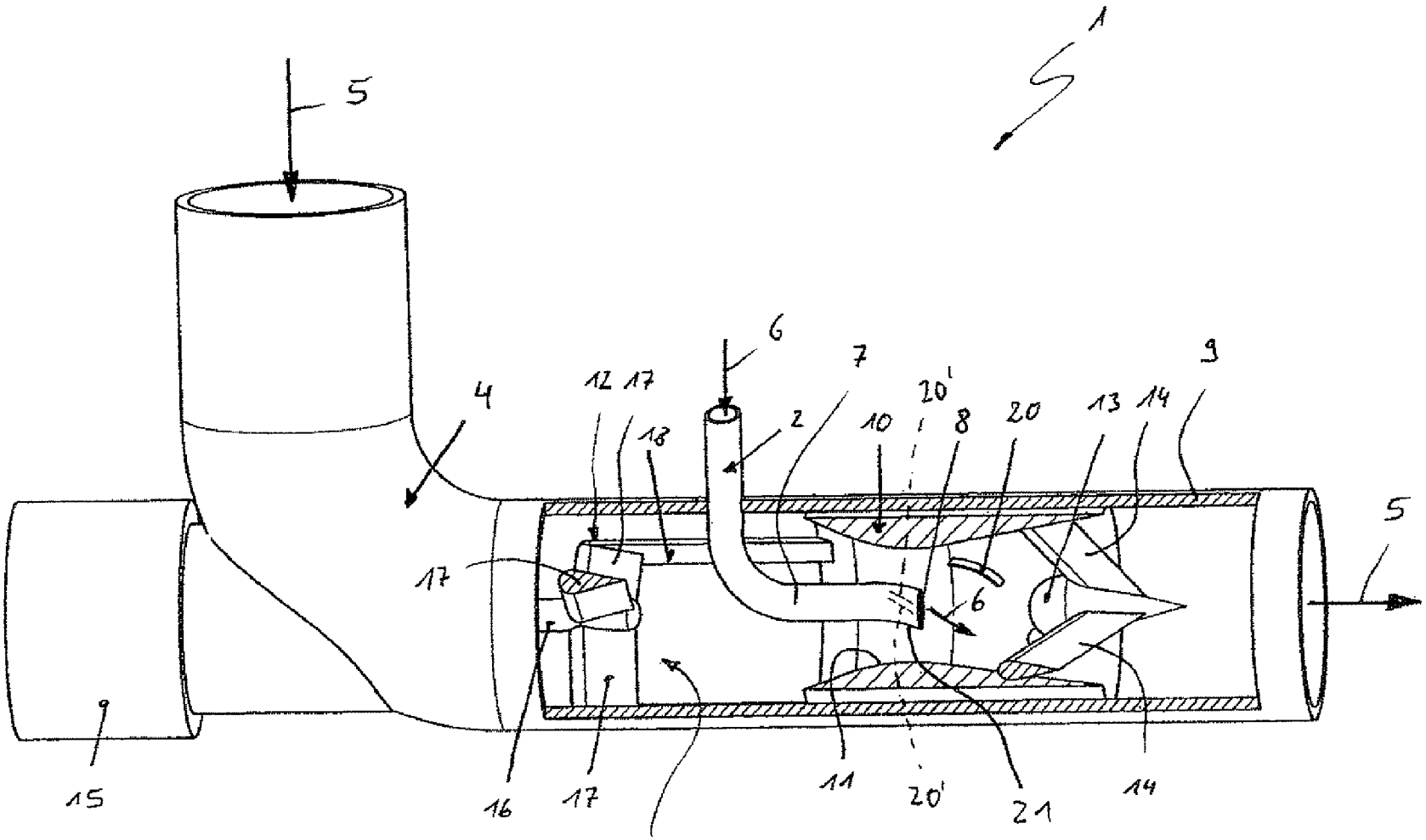

According to the embodiment shown in FIG. 6, the EGR valve 3 may additionally be equipped with at least one flow conduction element 20. This flow conduction element 20 is designed in such a way that it at least partially conducts the exhaust gases exiting from the orifice opening 8 past the closure body 13 in the event of active exhaust gas recirculation. It is fundamentally possible to fasten a flow conduction element 20 of this type to the sleeve 10 as in the illustrated embodiment, the flow conduction element 20 being located inside the fresh air line 4 upstream from the closure body 13. It is clear that the flow conduction element 20 fastened to the sleeve 10 is positioned in such a way that it does not collide with the end section 7 upon adjustment of the sleeve 10. Alternatively, the flow conduction element 20 may also be fastened to the closure body 13 in principle.

Moreover, a variant is illustrated in FIG. 6 which may be used cumulatively or alternatively, in which two flow conduction elements 20' are situated in the EGR line 2 and/or in its end section 7 upstream from the orifice opening 8. It is also possible to fasten the flow conduction element 20 to the end section 7 in such a way that it is located upstream from the orifice opening 8 in the fresh air line 4. It is clear that the flow conduction element 20 fastened to the end section 7 is positioned in such a way that it does not collide with the closure body 13 upon adjustment of the sleeve 10.

The flow conduction elements 20, 20' shown here are fundamentally subjected to a strong impingement by exhaust gas, however, these flow conduction elements 20, 20' do not participate in the setting of the EGR rate, so that fouling or sooting of these flow conduction elements 20, 20' has no influence on the function of the EGR device 1.

Additionally or alternatively to the at least one flow conduction element 20, 20', the end section 7 may have an inclined course in relation to the flow direction of the fresh air flow 5, at least in an end area 21 having the orifice opening 8. In this way, the exhaust gas receives a directional component at the orifice opening 8 which guides the exhaust gas past the closure body 13 situated aligned with the orifice opening 8. With the aid of the inclined end area 21 and/or with the aid of the at least one flow conduction element 20, 21, a direct impingement of the closure body 13 with the recirculated exhaust gases is avoided, by which the danger of fouling or sooting of the closure body 13 is reduced.

In the embodiments shown here, the end section 7 extends at least regionally parallel to the fresh air line 4. The end section 7 or at least the orifice opening 8 is expediently situated concentrically inside the fresh air line 4.

However, an eccentric configuration of the orifice opening 8 is also fundamentally possible.

Figure 7:
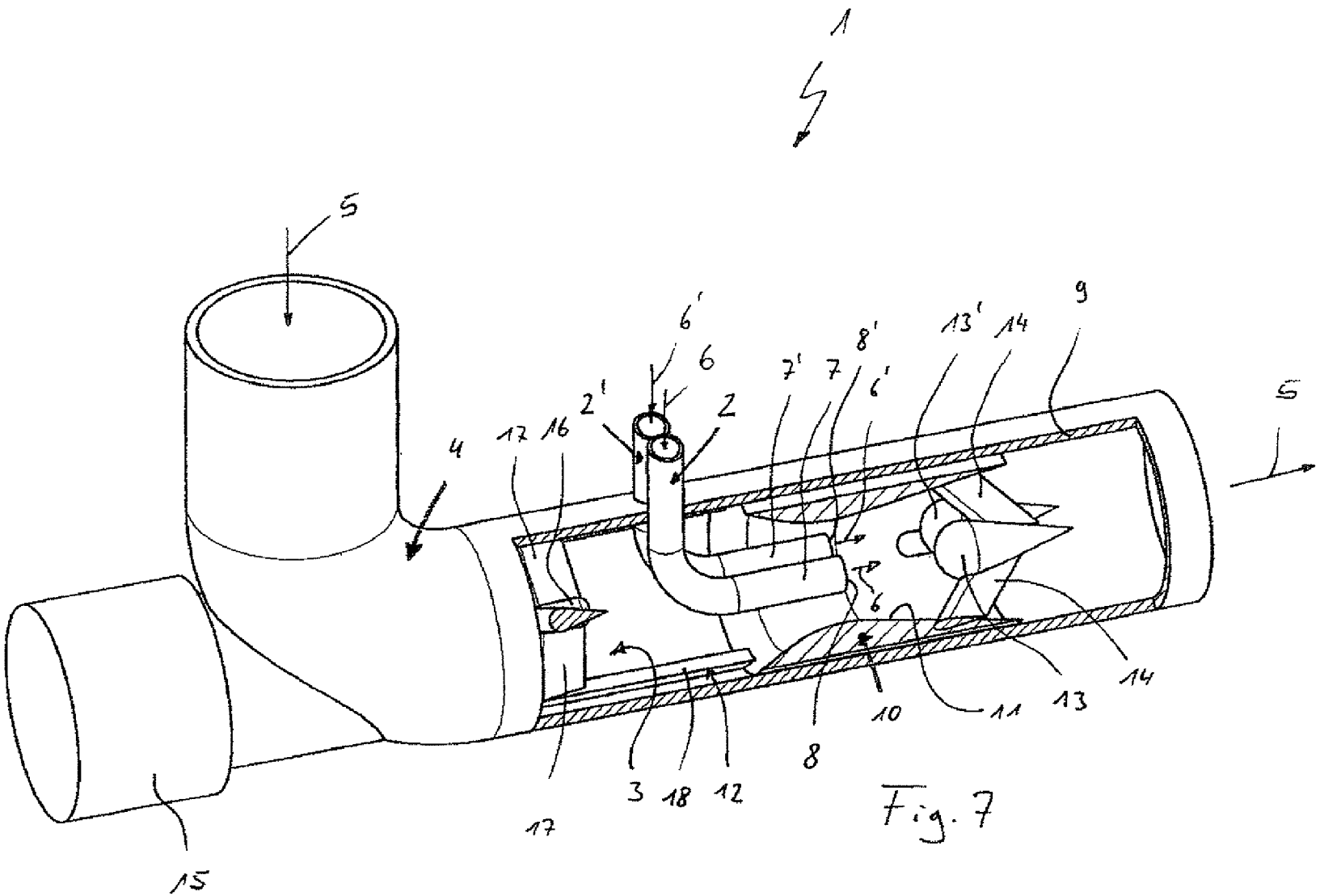
Figure 8:
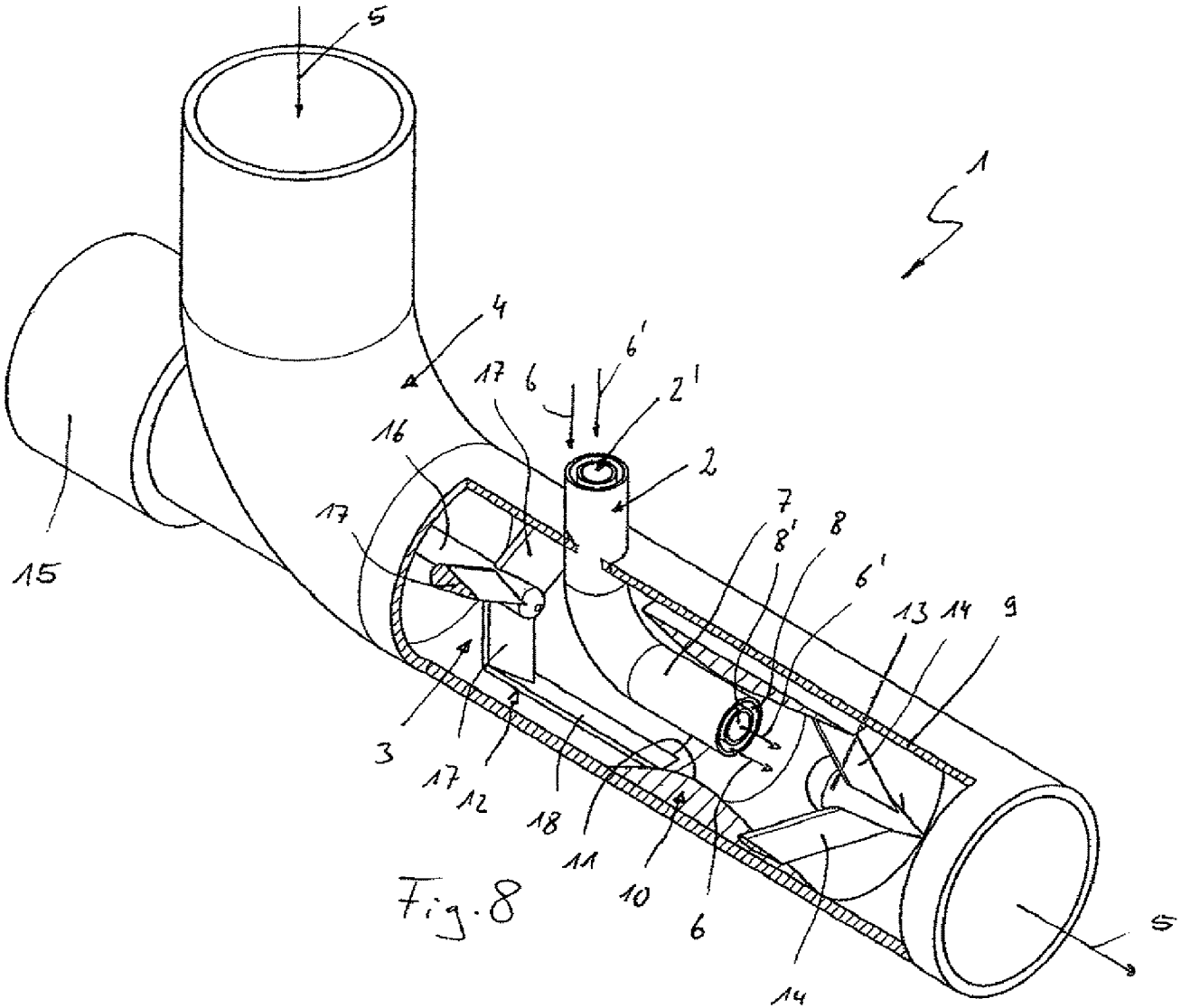

In the embodiments of FIGS. 1 through 6 and 9, only a single EGR line 2 is provided in each case. In some internal combustion engines, exhaust-side pulsations may arise, which may have a disadvantageous effect on the exhaust gas recirculation. To avoid such feedback, it may be expedient to provide more than one EGR line 2, the individual EGR lines 2 being assigned on the exhaust side to various cylinders or various cylinder groups of the internal combustion engine. Correspondingly, FIGS. 7 and 8 show two exemplary embodiments for variants of the EGR device 1, which each operate using two EGR lines 2 and 2'. Using both EGR lines 2, 2', the exhaust gases may be introduced in parallel into the fresh air line 4 in the event of active exhaust gas recirculation. The two EGR lines 2, 2' are expediently assigned to two different cylinders or cylinder groups of the internal combustion engine.

In the embodiment shown in FIG. 7, the two EGR lines 2, 2' are designed separately and led separately through the envelope 9 of the fresh air line 4. Furthermore, the two orifice openings 8, 8' of the two end sections 7, 7' are expediently situated adjacent to one another inside the fresh air line 4. In the variant shown in FIG. 7, the EGR valve 3 for controlling the EGR lines 2, 2' is equipped with two closure bodies 13, 13', which are fastened jointly to the sleeve 10 and are jointly positionable by axial adjustment of the sleeve 10 in relation to the particular orifice opening 8, 8'.

In contrast thereto, in the embodiment shown in FIG. 8, the two EGR lines 2, 2' are implemented as integrated. In the preferred embodiment shown, the two EGR lines 2, 2' are situated coaxially one inside the other. The exhaust gases of the internal EGR line 2' are transported to the interior of the internal EGR line 2', while the exhaust gases of the external EGR line 2 are transported in the annular space between the external EGR line 2 and the internal EGR line In this embodiment, the orifice openings 8, 8' of the two EGR lines 2, 2' are also situated concentrically to one another and/or concentrically one inside the other within the fresh air line 4. The two orifice openings 8, 8' may be situated offset to one another in the axial direction in such a way that one joint closure body 13 is sufficient to close the orifice opening 8 of the external EGR line 2 or both orifice openings 8, 8' simultaneously.

According to FIG. 9, the EGR device 1 may additionally be equipped with a fresh air auxiliary line 22 in a further embodiment. This fresh air auxiliary line 22 extends at the outlet side in the end section 7 of the EGR line 2, coaxially to the end section 7 and at least up to its orifice opening 8. In FIG. 9, an outlet-side end of the fresh air auxiliary line 22 is recognizable, which is situated concentrically in the orifice opening 8.

Fresh air, which enters the fresh air line 4 through the orifice opening 8 in the event of active exhaust gas recirculation, may be introduced centrally into the exhaust gas flow 6 with the aid of this fresh air auxiliary line 22. The fresh air entering the fresh air auxiliary line 22 at the inlet and exiting at the outlet is symbolized in FIG. 9 by arrows 23. Because the orifice opening 8 is preferably oriented aligned to the closure body 13, the outlet-side end of the fresh air auxiliary line 22 is also aligned with the closure body 13. Correspondingly, the closure body 13 is impinged with the centrally flowing fresh air 23 from the fresh air auxiliary line 22, which flows around the closure body 13, in the event of active exhaust gas recirculation. A kind of protective film made of fresh air for the closure body 13 is thus formed, which prevents or at least makes more difficult a direct contact of the closure body 13 with the recirculated exhaust gases 6. The danger of contamination of the closure body 13 is thus significantly reduced.

To be able to introduce fresh air 23 centrally into the recirculated exhaust gases 6, the fresh air auxiliary line 22 is coupled at the inlet to a corresponding fresh air source. In the present case, the fresh air auxiliary line 22 extends on the inlet side up into the fresh air line 4, in such a way that its inlet-side end is located upstream from the orifice opening 8 of the EGR line 2. This is achieved here in that the fresh air auxiliary line 22 extends through a wall of the EGR line 2 (not shown in greater detail). The inlet-side end of the fresh air auxiliary line 22 is then located upstream from the EGR line 2 in the fresh air line 4. The fresh air auxiliary line 22 preferably extends linearly between its ends, as here.

The positioning of the outlet-side end of the fresh air line 22 within the orifice opening 8 is expediently performed in such a way that at least the orifice opening 8 may be closed in the desired way with the aid of the closure body 13 in the event of deactivated exhaust gas recirculation. Simultaneously, the outlet-side end of the fresh air auxiliary line 22 may additionally be closed with the aid of the closure body 13. If a predetermined minimum gap is to remain open as the minimal cross-section for the orifice opening 8, a corresponding stop for the closure body 13 may be defined with the aid of the outlet-side end of the fresh air auxiliary line 22.

It is clear that in an embodiment having two EGR lines 2, 2', two fresh air auxiliary lines 22 may also accordingly be provided.

In the embodiment shown FIG. 9, the fresh air 23 which is injected centrally into the recirculated exhaust gases 6 is taken internally from the fresh air line 4. In another embodiment, an external feed of this fresh air 23 is also fundamentally conceivable. For example, the fresh air auxiliary line 22 may run coaxially inside the (first) EGR line 2 like the second EGR line 2' in the embodiment shown in FIG. 8 and be connected to a corresponding fresh air supply at a suitable point.

The invention claimed is:

1. An exhaust gas recirculation device for an internal combustion engine, comprising:

at least one exhaust gas recirculation line configured to introduce exhaust gas into a fresh air line of the internal combustion engine, an exhaust gas recirculation valve for controlling a flow of the at least one exhaust gas recirculation line, the at least one exhaust gas recirculation line having an end section disposed within the fresh air line, having an axially open orifice opening, wherein the exhaust gas recirculation valve has a sleeve situated in the fresh air line, the sleeve enveloping the at least one exhaust gas recirculation line in the area of the orifice opening, the sleeve being axially adjustable along the fresh air line, the sleeve having a nozzle contour defining a cross-section which first decreases and then increases in the flow direction, wherein the exhaust gas recirculation valve has a control element for axially adjusting the sleeve in relation to the fresh air line, wherein the exhaust gas recirculation valve includes at least one closure body, the at least one closure body configured to cooperate with the orifice opening of the exhaust gas recirculation line to adjust an open cross-section of the orifice opening of the exhaust gas recirculation line, the at least one closure body configured such that adjustment of the sleeve also adjusts the closure body relative to the orifice opening, and wherein the at least one closure body that cooperates with the sleeve to set a minimum cross-sectional opening of the at least one exhaust gas recirculation line when the sleeve is adjusted maximally upstream.

2. The exhaust gas recirculation device of claim 1, wherein the at least one closure body is configured to close the orifice opening when the sleeve is adjusted maximally upstream.

3. The exhaust gas recirculation device of claim 1, wherein the at least one closure body and the orifice opening are disposed generally coaxial with respect to each other.

4. The exhaust gas recirculation device of claim 1, wherein the at least one closure body has a generally semispherical profile on an inflow side of the at least one closure body.

5. The exhaust gas recirculation device of claim 1, wherein the at least one closure body has a generally conical profile on an outflow side of the at least one closure body.

6. The exhaust gas recirculation device of claim 1, wherein the at least one closure body is connected to the sleeve via at least one radial web.

7. The exhaust gas recirculation device of claim 1, wherein one of the at least one closure body and the orifice opening includes an adhesion-reducing coating.

8. The exhaust gas recirculation device of claim 1, wherein at least one seal element is disposed on one of the at least one closure body and the orifice opening.

9. The exhaust gas recirculation device of claim 1, wherein the control element includes an actuator connected to the sleeve, the actuator disposed in the fresh air line upstream from the orifice opening.

10. The exhaust gas recirculation device of claim 9, wherein the actuator is connected to the sleeve via one of a radial web and an axial web.

11. The exhaust gas recirculation device of claim 9, wherein the control element includes an actuating drive for axially adjusting the actuator, the actuating drive disposed outside the fresh air line, the actuator penetrating an envelope of the fresh air line to form a seal.

12. The exhaust gas recirculation device of claim 1, further comprising at least one flow conduction element configured to direct at least a portion of exhaust gases exiting from the orifice opening around the closure body.

13. The exhaust gas recirculation device of claim 12, wherein the at least one flow conduction element is disposed upstream of the orifice opening.

14. The exhaust gas recirculation device of claim 12, wherein the at least one flow conduction element is disposed downstream of the orifice opening in the fresh air line.

* * * * *